US010774851B2

(12) United States Patent
BUSANI et al.

(10) Patent No.: US 10,774,851 B2
(45) Date of Patent: Sep. 15, 2020

(54) MODULAR DIRECTIONAL VALVE WITH TWO OR MORE ELEMENTS OF MIXED TYPE

(71) Applicant: WALVOIL S.P.A., Reggio Emilia (IT)

(72) Inventors: Ulderico BUSANI, Reggio Emilia (IT); Daniele Dodi, Reggio Emilia (IT); Massimiliano Musiani, Reggio Emilia (IT)

(73) Assignee: WALVOIL S.P.A., Reggio Emilia (IT) (IT)

( * ) Notice: Subject to any disclaimer, the term of this patent is extended or adjusted under 35 U.S.C. 154(b) by 88 days.

(21) Appl. No.: 16/063,287

(22) PCT Filed: Dec. 16, 2016

(86) PCT No.: PCT/EP2016/081417
§ 371 (c)(1),
(2) Date: Jun. 17, 2018

(87) PCT Pub. No.: WO2017/103100
PCT Pub. Date: Jun. 22, 2017

(65) Prior Publication Data

US 2018/0372127 A1 Dec. 27, 2018

(30) Foreign Application Priority Data

Dec. 18, 2015 (IT) ..... UB2015A9494

(51) Int. Cl.
*F15B 11/17* (2006.01)

(52) U.S. Cl.
CPC ..... *F15B 11/17* (2013.01); *F15B 2211/20538* (2013.01); *F15B 2211/20546* (2013.01);
(Continued)

(58) Field of Classification Search
CPC ..... F15B 11/17; F15B 2211/7142; F15B 2211/88; F15B 2211/20538; F15B 2211/20546
(Continued)

(56) References Cited

U.S. PATENT DOCUMENTS 7,571,558 B2 * 8/2009 Horii ..... E02F 9/2239 37/348

* cited by examiner

*Primary Examiner* — Thomas E Lazo
*Assistant Examiner* — Daniel S Collins
(74) *Attorney, Agent, or Firm* — Kristina Castellano; Castellano PLLC

(57) ABSTRACT

A modular directional valve with two or more elements (E1, E2, E3, E4) in turn connectable to respective utilities (U) through the uses (A1, B1, A2 . . . B4); of which one or more elements (E1 E2) are of the CA type while one or more elements are of LS flow sharing type (E3, E4). The valve designed to be connected to a first high pressure line P1 which connects the crossing elements to a constant displacement pump (PA) and a second high pressure line P2 which connects the LS flow sharing type elements to a variable displacement pump LS, the connection to a low pressure line, the connection to a load sensing signal line (LS2) with the variable displacement pump LS (PB). Said valve acting so that if the load sensing flow sharing elements (E3, E4) fed by the line (P2) designed for the connection with the pump (PB) are in saturation, it withdraws from the carry over (6) of the group of elements (E1, E2) of the crossing type the amount of flow rate equal to the difference between the flow rate required by the utilities (U) of the elements (E3, E4) and the maximum flow rate which can be supplied by the LS pump (PB); otherwise, it freely delivers the flow rate of the constant displacement pump to the low pressure line.

2 Claims, 2 Drawing Sheets

(52) U.S. Cl.
CPC ..... *F15B 2211/20576* (2013.01); *F15B 2211/30555* (2013.01); *F15B 2211/30595* (2013.01); *F15B 2211/3116* (2013.01); *F15B 2211/7142* (2013.01)

(58) Field of Classification Search
USPC ..... 60/422
See application file for complete search history.

E3

MODULAR DIRECTIONAL VALVE WITH TWO OR MORE ELEMENTS OF MIXED TYPE

CROSS REFERENCE TO RELATED APPLICATIONS

This is a U.S. National Stage application of PCT/EP2016/081417 filed on Dec. 16, 2016, which claims the benefit of Italian application UB2015A009494, the contents of both of which are incorporated herein by reference.

SCOPE OF THE INVENTION

The present invention relates to the field of hydraulic valve devices with multiple working sections, of which a part consists of crossing elements fed by a constant displacement pump and the rest of LS flow sharing elements fed by an LS variable displacement pump.

The valve is a valve body consisting of multiple sections, each serving a utility. It is also known as hydraulic distributor.

The protection extends to all hydraulic distributors having the claimed valve device.

PRIOR ART

It is known that the introduction of LS systems allows diversifying the flow rates to the single utilities, making such flow rates independent of loads and independent of the flows rates and pressures of the other utilities.

Moreover, in the case of multiple actuations causing the pump saturation (when the flow required is greater than the maximum delivered by the pump), the flow delivered by the pump in LS flow-sharing systems is divided among the various utilities in proportion to the requirement of the single spool so as to maintain the combined motion.

To this end, the load-sensing flow-sharing distributors take the pressure after the spool and, once the LS signal is initiated, they send it to an LS pump which before the spool, forces a pressure equal to the LS pressure plus a fixed stand-by. This causes a fixed pressure stage through the dispensing recesses of the spool and thereby a fixed flow rate, irrespective of the LS pressure but only as a function of the passage area opened by the dispensing recesses of the spool.

In the case of concurrent actuation of multiple utilities, the distributor is provided with a system adapted to send the highest pressure among those actuated to the LS pump. To keep the load-sensing feature in utilities with a lower pressure, a set of local compensators is provided, one for each element.

The above brings benefits compared to the solution with constant displacement and crossing distributors for which you cannot determine a maximum flow rate diversified according to the utility, the flow rate to the users depends on the load on the utility and is also influenced by the pressures and flow rates of other utilities.

Moreover, the LS variable displacement pump only sends the required flow rate, that is, the one that generates the forced pressure stage, and therefore there is no excess flow rate, whereby the energy saving is apparent compared to the case of constant displacement pump, in which the pump always sends the whole flow rate which is all brought to the pressure imposed by the utility and which is then partly laminated directly to drain, with a noticeable energy dissipation which transforms into oil heat.

However, not everything is an advantage. The same feature that the flow rate at the utility is independent of the load makes it more reactive than a crossing system. In LS systems, once a spool is operated, the flow rate immediately reaches the required value by generating a significant acceleration to the users while the crossing systems, since the flow rate is load-dependent, have their own inherent flow rate increase ramp to the utilities which makes the start smoother.

In a utility such as the rotation of an excavator, in which the operator moves integral with the rotation itself, the responsiveness of the LS system is unpleasantly perceived by the operator himself.

Moreover, the fact that the LS pump only sends the required flow rate undoubtedly allows an energy saving. However, if multiple elements are operated simultaneously, the pump certainly sends only the total required flow rate, which is however entirely raised to the pressure induced by the increased load, also the flow rates that feed utilities which would need low pressures for moving. In these elements, the excess pressure is dissipated by the local compensators of the lower load elements. It is clear that the difference between the total flow rate sent to the elements minus that sent to the utilities at a higher pressure multiplied by the difference in pressure between the utility with higher load and the other loads is all a dissipation of energy.

The constant displacement pump system would be even worse because it does not send the required flow rate only but it sends the whole flow rate.

However, there are utilities such as rotation, tilting, blade (often used together with the travel) that require little pressure, so the use in conjunction with other functions that use high pressures always generates a high energy dissipation.

For constructional reasons, it is not feasible to connect each utility to its own pump subjected to its own pressure. However, it is possible to switch to hydraulic circuits supplied by at least two pumps so that each pump is subject to its working pressure. Of this, one at fixed displacement and crossing elements that allows smooth drives to the rotation and under which the elements that operate at low pressure are inserted, such as the blade and tilting, and one of the load sensing type with the energy benefits and the control of the machine that supplies the excavation and travel functions.

It is common that the LS pumps used to supply the travel and the excavation functions are not able to supply such a flow rate to satisfy all the utilities simultaneously. In the case of multiple movements, the pump often goes into saturation and this is why the systems are LS flow sharing, since these systems ensure that, in a condition of saturation (that is, the flow rate required by the utilities is less than the maximum operating capacity), the available flow rate is proportionately divided among the utilities operated as a function of the same drive.

In case of saturation, if none of the functions is used under the fixed displacement pump, it is a waste not to recover also this flow rate to supply the functions requiring flow rate.

U.S. Pat. No. 7,571,558 uses a third fixed displacement pump enabled based on the delivery pressure and the elements actuated.

The patent document U.S. Pat. No. 5,165,862 is also known which integrates a constant displacement pump with the load sensing type when in saturation. The difference with the present invention lies in the characterizing part of the invention, in particular in that it does not describe any crossing group or priority functions of the respective elements crossed thereby. In addition, it includes no additional valve and choke with the advantages described hereinafter.

DESCRIPTION AND ADVANTAGES OF THE INVENTION

A first object of the present invention is to provide a modular directional valve with two or more elements and of mixed type, meaning that one or more elements are of the crossing type, fed by a constant displacement pump, and one or more elements are of the load sensing, flow sharing type and fed by a variable displacement pump LS.

A second object is to manufacture a modular directional valve within a simple, rational and cost-effective solution.

These and other objects are achieved with the features of the invention described in the independent claim 1. The dependent claims describe preferred and/or particularly advantageous aspects of the invention.

In particular, a first aspect of the invention is to provide a device capable of automatically withdrawing, in a situation of saturation, from the flow rate of the constant displacement pump that flow rate able to fill in the difference between the flow rate required by the utilities and the maximum flow rate delivered by the LS pump.

With this solution, in case of saturation, if none of the functions is used under the fixed displacement pump, also this flow rate is recovered to supply the functions requiring flow rate.

Another aspect of the invention is to provide a valve able to deliver to tank, i.e. at low pressure, the flow rate of the constant displacement pump if the functions under the load sensing pump are not in saturation.

This solution allows the free bleed in T of the pump to the crossing pressure drop value.

Another aspect of the invention is to provide a valve acting so as to maintain a priority to the functions under the constant displacement pump.

With this solution, actuating one of these functions, the flow rate feeds the function activated and the group under the LS pump operates only with the flow rate of its LS pump.

All of the above is ensured by a summation element, intermediate between the group of crossing elements and the LS flow sharing group, which:

- Connects the carry over of the crossing elements to the pressure relief channel of the LS group through a one-way valve that allows the flow from the carry over to the pressure release channel and not vice versa,
- Connects the carry over, upstream of the one-way valve, to a two-way two-position piloted spool which opens, close or chokes the connection between the carry over and the low pressure line to tank.

Said two-way two-position piloted spool is subject on one side to the pressure of the pressure relief channel in the direction of opening the passage, on the other side to the LS signal plus a corresponding spring, depending on the diameter of the piloted spool, at a pressure slightly lower than the LS pump stand-by and acts to close the passage between the carry over and the low pressure line to tank.

According to possible embodiments, the invention provides a choke 10, placed along the LS signal, and a pressure relief valve 11, both associated in said summation element 3. The pressure relief valve 11 is placed downstream of the choke towards piloted spool 4 and is calibrated lower than the valves in the two inlet sides 12 and 13 which limits the maximum pressure on the spring side of piloted spool 4.

With this solution, if the LS signal exceeds the value of the pressure relief valve 11, piloted spool 4 switches to opening setting to tank, at low pressure, the constant displacement pump flow rate. Therefore, at high pressure, the flow rate under pressure is reduced, thereby reducing the engine torque demand.

In summary, the object of the invention is a mixed-type valve, i.e. consisting of at least two groups of elements which can be controlled by respective pumps, one of which is constant flow rate and the other variable of LS type.

When the elements are in saturation, the valve draws from the line connected to the fixed displacement pump the amount of flow rate needed to fill the difference between the flow rate required by the utilities of the elements and the maximum flow rate supplied by the LS pump, while otherwise it sends, at low pressure, the constant displacement pump flow rate to the low-pressure line.

This takes place by connecting the elements with the summation element which is in fact intended to automatically withdraw the flow rate missing from the load sensing flow sharing group of elements in case of saturation.

Said objects and advantages are all achieved by the valve object of the present invention, which is characterized by the following claims.

BRIEF DESCRIPTION OF THE FIGURES

This and other features will become more apparent from the following description of some of the configurations, illustrated purely by way of example in the accompanying drawings.

Figure 1:
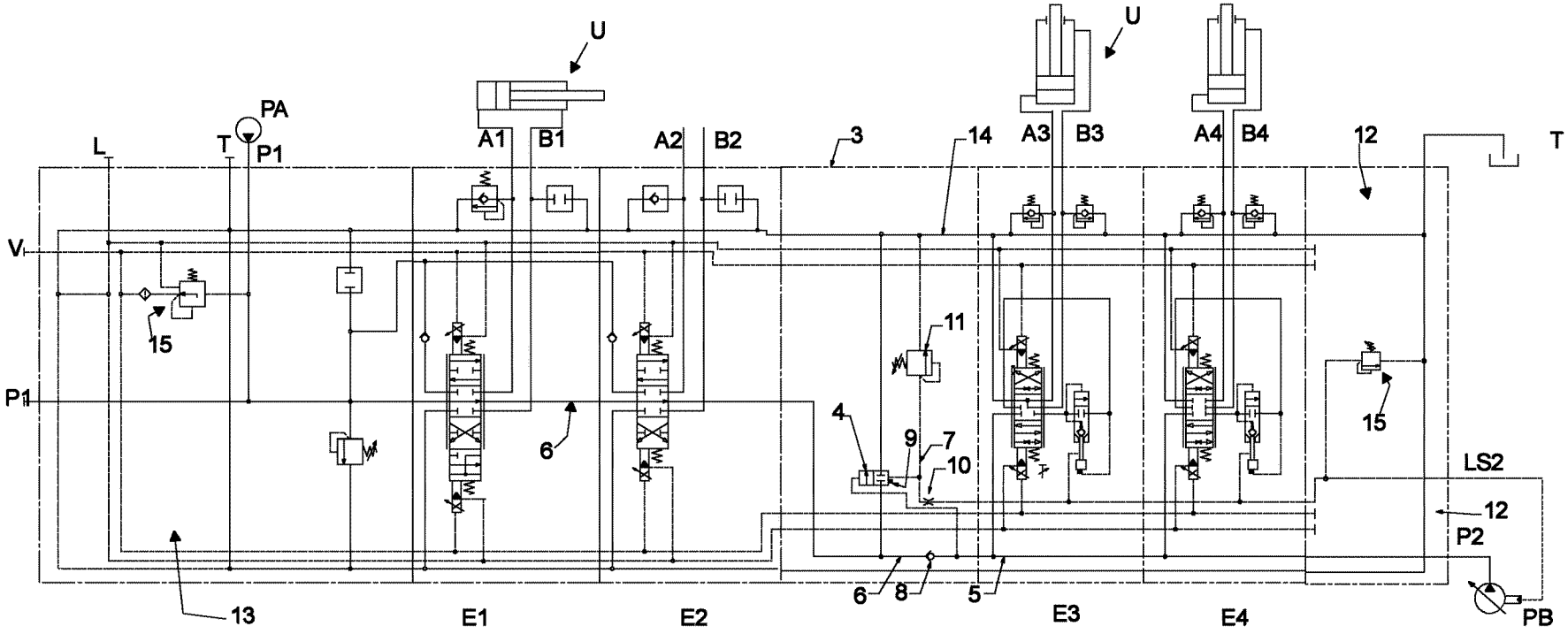
FIG. 1: shows the circuit diagram of a mixed load-sensing flow-sharing crossing hydraulic valve with intermediate summation element 3.
Figure 2:
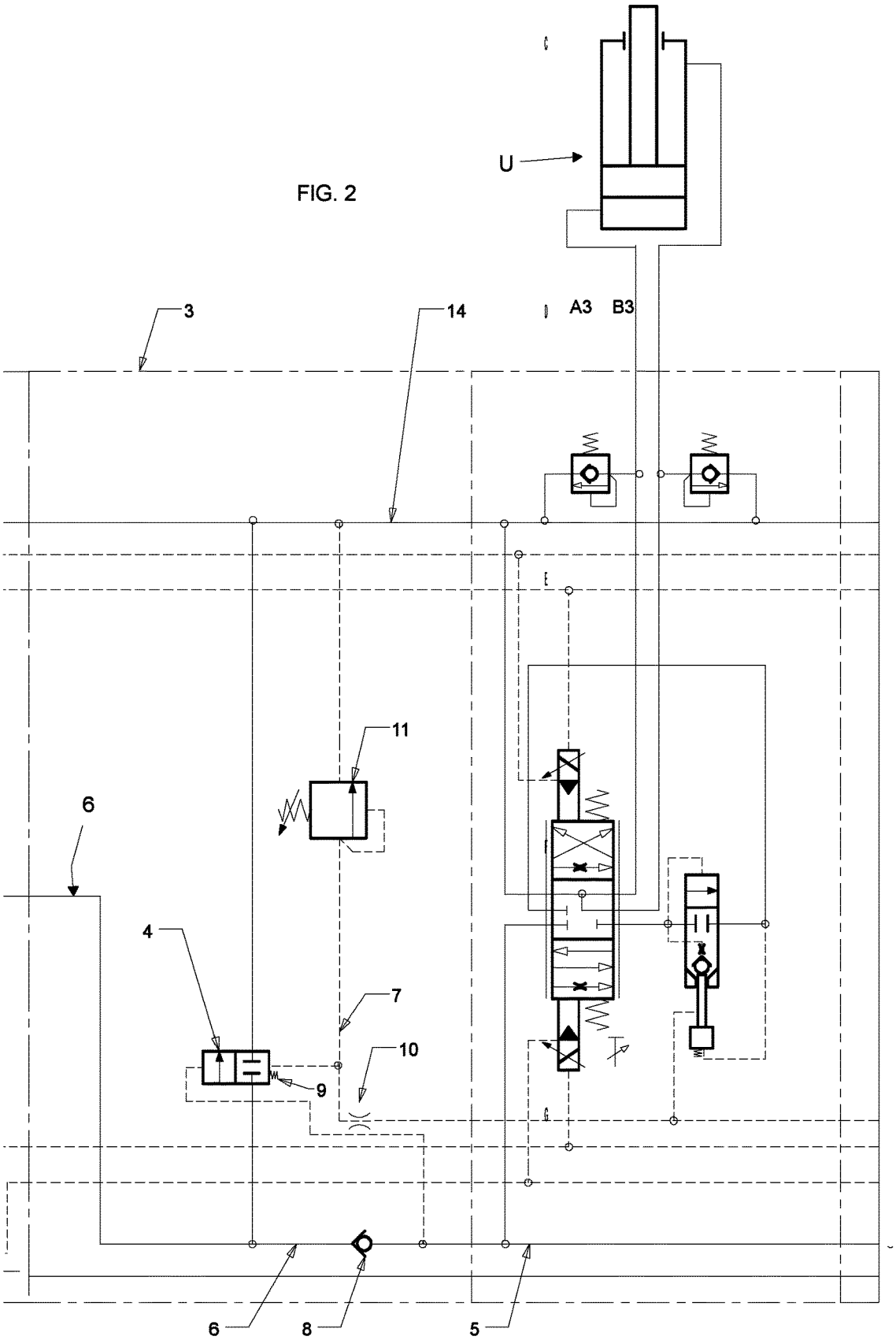
FIG. 2 shows the detail of the intermediate summation element 3.

The circuit of the hydraulic valve object of the invention is shown in FIGS. 1 and 2 and describes the invention thereof.

More precisely, the circuit consists of two independent circuits separated by an intermediate summation element 3 between the two groups of crossing elements E1 and E2, flow sharing E3 and E4.

The first circuit consists of an inlet side 12 and a series of through type elements E1, E2, namely sections, representing connections with a series of utilities.

The second circuit consists of an inlet side 13 and a series of load sensing flow sharing elements E3, E4, namely sections, representing connections with a series of utilities U.

The first circuit is supplied by a constant displacement pump PA.

The second circuit is supplied by an LS PB pump.

The two circuits are connected together by a summation element 3 which comprises a number of components, connected to one another through conduits, pathways and connections, capable of connecting or separating the two groups of elements with the relative sides and pumps.

The valve circuit describing a hydraulic distributor comprises:

- Two feeding channels P1 and P2, respectively connected to two feeding apparatus PA and PB, where PA identifies a constant displacement pump, PB an LS variable displacement pump, which feed the sides, identified by 12 and 13 respectively, and the relative downstream elements E1, E2, E3, E4, at high pressure. It should be noted that the number of elements varies depending on the number of utilities U to be connected.

A tank line 14, connected to a low pressure tank T, into which all bleeds flow, A channel of the load-sensing signal LS2 from the group of load sensing flow sharing elements E3 and E4, which has the function of sending the LS signals to the LS PB pump.

The summation element 3 is arranged between the through type elements E1, E2, and load sensing flow sharing elements E3, E4.

The summation element 3 includes a two-way two-position piloted spool 4 and connects the carry over line of the through type elements to the load line 5 of the LS group through a one-way valve 8 that allows the flow from the carry over 6 to the pressure load line 5 and not vice versa.

In the end positions, piloted spool 4 connects the carry over 6 of the crossing group to the tank T or closes such a connection.

Element 3 can also position itself in the various intermediate positions, thereby choking such a passage.

On the one hand, piloted spool 4 is subject to the pressure of the LS signal of the flow sharing group added to the action of a spring 9 which, as a function of the diameter of the tray itself, corresponds to a pressure slightly lower than the pump stand-by.

On the other hand, piloted spool 4 is subject to the pressure of the load line 5 taken downstream of the one-way valve 8.

If no element E is actuated, the LS signal of the flow sharing group is null and the LS PB pump does not send flow rate but that needed to compensate for leakage and maintain the pump stand-by pressure on the pressure load line 5. Such a pressure also acts on summation element 3 of the piloted spool 4 in the direction of opening of the passage. On the other side, there acts the LS pressure plus spring 9 corresponding to a pressure spring LS, depending on the diameter of the tray, slightly lower than the stand-by value of the LS PB pump. For this reason, piloted spool 4 opens completely, thus allowing the flow rate of the constant displacement pump PA to flow to tank T only at the load loss pressure.

The provision of the one-way valve 8 between the pressure load line 5 and the carry over 6 prevents the flow rate of the LS system from adding to the flow rate of the crossing system, thus going to tank.

Let's assume that E3 and E4 are actuated so that the LS group is still not in saturation. According to the above, on the LS systems each utility will receive its own required flow rate irrespective of the loads and irrespective of the other utility actuated.

Since it is not in saturation, piloted spool 4 of element 3 is still kept open as said above, whereby the flow rate of the constant displacement pump PA continues to freely go to tank T at the load losses only.

E1 and E2 are elements whose utilities are properly selected among those that require lower actuating pressures and for which smooth actuation is very important.

Assuming that E1 and E2 are activate, then the constant displacement pump flow rate are divided according to the relative loads, however the pressure set will not be affected by the pressure of E3 and E4 but will only be that strictly necessary to the actuation of the related functions.

Moreover, due to the same inherent characteristic of the crossing system, in which the flow rate to the utilities depends on the load, increasing ramps of the flow rate to the utilities are obtained which makes the management of a function like rotation smoother.

Let's now assume that only E3 and E4 are actuated and that the LS group goes into saturation. An immediate consequence of the saturation is that the difference between the load line pressure 5 and the pressure of the LS signal, indicated with 7, is reduced compared to the stand-by value of the pump.

Now, if this difference falls below the pressure corresponding to the action of spring 9 with respect to the diameter of the piloted spool, piloted spool 4 begins to choke the connection between the carry over 6 of the crossing system and tank T and continues until the difference between the pressure load line 5 and the LS signal 7 is equal to the pressure generated by spring 9. For this to happen, piloted spool 4 will choke until the pressure in the carry over 6 will exceed the pressure of the pressure load line 5, thus opening the one-way valve 8 and sending the flow rate in addition to that of the LS PB pump.

It is also noted that if too much flow rate is delivered, the difference between the pressure load line 5 and the LS signal 7 overcomes the action of spring 9 again, whereby the piloted spool 4 tends to open again, thus reducing the flow rate delivered in addition to the LS PB pump.

It follows that the flow rate sent in addition is exactly what is necessary to keep the LS system stand-by constant to the value of spring 9 in relation to the piloted spool diameter. In practice, the system continues to act like an LS system.

The added flow rate is withdrawn from the carry over 6; this means that there is a priority of the crossing elements E1 and E2 in the use of the flow rate of the constant displacement pump PA with respect to any flow rate demand of the LS group in saturation.

In fact, by operating the crossing elements, the carry over is no longer fed and therefore piloted spool 4 cannot intervene as required when the LS group is in saturation. The LS group will continue to operate as a normal LS flow sharing group that in saturation divides all the maximum flow rate of the LS PB pump among the various utilities of the LS group proportionally to the single demands. This ensures simultaneous flow rate to all functions.

With this solution, if all functions are actuated simultaneously, all will receive flow rate: E1 and E2 will use the flow rate of their constant displacement pump PA while functions E3 and E4 will use the flow rate of the LS pump in saturation which, according to the flow sharing logic, will be divided among the utilities in proportion to the actuation of the spool.

As mentioned, the intermediate element 3 include a choke 10 and a pressure relief valve 11, their task is not so much related to the functionality described above but is extra and can be considered an option.

Assuming to be so much in saturation of the LS group with all the flow rate of the constant displacement pump PA returned and that the greatest load requires a pressure close to the setting of the pressure relief valve 12.

The whole flow rate of the PA pump plus the whole flow rate of the PB pump will rise to such a pressure and the torque limiter triggers.

However, it doesn't make much sense to add the flow rate of the PA pump to that of the PB pump if the flow rate of the PB is reduced.

To this end, the relief valve 11 is introduced.

The relief valve 11 is calibrated a few dozen bars lower than the calibration of the relief valve 12.

Assuming again the situation of saturation and load that imposes a pressure lose to the setting of the pressure relief valve 12, we have now that while the pressure reaches such a pressure close to the setting of the relief valve 12 in the inlet side, the relief valve 11 in the intermediate element 3 imposes its pressure, lower than that imposed by the loads by a few dozen bars, after choke 10, that is, in the chamber of spring 9 of piloted spool 4. Since valve 11 is calibrated lower, an imbalance occurs at the side of piloted spool 4 such that:

on the spring side, the calibration pressure of valve 11 plus spring acts, on the opposite side, the pressure of the pressure load line 5 which is given by the pressure of the LS signal, close to the setting of valve 12, plus the stand-by.

Piloted spool 4 is then fully moved to the open position of the passage between the carry over 6 and T, although in saturation. This allows freely bleeding the flow rate of the constant displacement pump PA to the load losses, thus reducing the power demand without affecting the internal combustion engine.

In other words, the above means that if even the LS signal pressure exceeds the setting of valve 11, the pressure acting on piloted spool 4 on the spring side 9 cannot exceed this value.

If the LS signal pressure is higher than the calibration of valve 11, more so is the pressure of the pressure load line 5 of the LS group: piloted spool 4, irrespective of saturation or not, opens, thus bleeding the flow rate of the PA in T through piloted spool 4 to the crossing load losses only.

The calibration of valve 11 is selected so that, multiplied by the sum of the maximum flow rates of pumps PA and PB, it requires such a power that does not affect the associated internal combustion engine, i.e. lower.

By setting the flow rate of the PA pump to tank at few bars, the LS group can reach the calibration pressures of the relief valve 12 without affecting the engine.

The pump is driven by a motor which will have its own power. Given the flow rate of PB, valve 15 is calibrated so that the system does not require a power greater than that of the engine. However, when the flow rate of PB is added to that of PA, the calibration of valve 15 is such as to require a higher power from the engine. In order to prevent this, valve 11 has been introduced, suitably calibrated to a value lower than 15 so that even with the sum of the two flow rates PA and PB, it requires a power always slightly lower than that of the engine. When the pressure reaches the calibration of valve 11, the flow rate of the PA pump freely goes to tank at low pressure through piloted spool 4, so that the flow rate of the PB pump can reach the pressure of valve 15 without exceeding the engine power.

In summary, the valve of the invention includes a summation element 3, connected to said through type elements E1, E2 and load sensing flow sharing elements E3, E4, the summation element 3 comprising a two-way two-position piloted spool 4 which, through the LC of the crossing through type elements E1, E2 connects or separates the delivery of the constant displacement pump PA from the tank.

Said piloted spool 4 subject:

in the opening direction, to the delivery pressure of the LS PB pump taken from the load line 5 before the one-way valve 8.

in the closing direction, to the LS signal of the flow sharing elements plus the action of a spring whose strength corresponds to a pressure slightly lower than the stand-by of the LS PB pump.

So configured, in the absence of flow rate demands by the through type elements E1 and E2:

in conditions of saturation of the load sensing flow sharing elements E3, E4, the piloted spool 4 of element 8 withdraws from the carry over line 6 of the crossing group of the through type elements E1, E2, the amount of flow rate needed to fill the difference between the total flow rate required by the utilities U of the load sensing flow sharing elements E3, E4 and the maximum flow rate dispensed of the LS pump PB.

in the absence of saturation of the load sensing flow sharing elements E3, E4, the piloted spool 4 of element 8 freely connects to the minimum pressure the carry over line 6 of the crossing group of the through type elements E1, E2 to the low pressure line 14 and thus to T.

The invention claimed is:

1. A modular directional valve assembly of mixed type, comprising:

a plurality of through type elements and a plurality of load sensing flow sharing elements connectable to respective utilities;

the valve assembly arranged for:

a. being connectable to high pressure lines and relative supply systems, b. being connectable to a low pressure line, to discharge, c. being connectable to a load sensing signal line, d. the plurality of through type elements being connectable to a constant displacement pump, e. the plurality of load sensing flow sharing elements being connectable to a load sensing variable displacement pump, and f. an adding element, connected to said through type elements and load sensing flow sharing elements; said adding element comprising a two-way and two-position piloted spool which connects the carry over line to the low pressure line or blocks such a connection and is subject to pressure of a load sensing signal of the load sensing flow sharing elements, and a one-way valve which allows the flow from a carry-over line to the load line but blocks the flow from the load line to the carry over line by connecting the carry over line of the through group type elements to the load line of the load sensing flow sharing elements;

wherein in the absence of flow rates from said through type elements and in saturated conditions of said load sensing flow sharing elements, the amount of flow rate needed to fill the difference between the flow rate required by the utilities of the load sensing flow sharing elements and the maximum flow rate supplied by the high pressure line is withdrawn from the carry over line of the group of elements of through type by the piloted spool blocking the connection between the carry over line and the discharge line.

2. The modular directional valve assembly according to claim 1, wherein the through type elements have priority in the use of the flow rate of the constant displacement pump with respect to the possible flow rate requirement of the load sensing flow sharing elements even in saturation.

* * * * *